US011518483B2

(12) United States Patent
Inoue

(10) Patent No.: US 11,518,483 B2
(45) Date of Patent: Dec. 6, 2022

(54) TRIM TAB FOR A SHIP AND A SHIP WITH THE TRIM TAB

(71) Applicant: YAMAHA HATSUDOKI KABUSHIKI KAISHA, Iwata (JP)

(72) Inventor: Hiroshi Inoue, Iwata (JP)

(73) Assignee: YAMAHA HATSUDOKI KABUSHIKI KAISHA, Iwata (JP)

( * ) Notice: Subject to any disclaimer, the term of this patent is extended or adjusted under 35 U.S.C. 154(b) by 69 days.

(21) Appl. No.: 16/843,364

(22) Filed: Apr. 8, 2020

(65) Prior Publication Data

US 2020/0324864 A1 Oct. 15, 2020

(30) Foreign Application Priority Data

Apr. 9, 2019 (JP) ..... JP2019-074328

(51) Int. Cl.
*B63B 39/06* (2006.01)

(52) U.S. Cl.
CPC ..... *B63B 39/061* (2013.01)

(58) Field of Classification Search
CPC ..... B63B 39/061; B63B 1/28; B63B 1/286
USPC ..... 114/284, 285
See application file for complete search history.

(56) References Cited

U.S. PATENT DOCUMENTS 3,601,078 A * 8/1971 Bedford ..... B63B 39/061 114/271
3,602,178 A * 8/1971 White ..... B63H 25/44 114/285
5,215,029 A * 6/1993 Davis ..... B63B 39/061 114/274
5,588,391 A * 12/1996 Tessandier ..... B63B 39/06 114/284
8,251,006 B2 * 8/2012 Kalil ..... B63B 39/061 114/285
2013/0312651 A1 * 11/2013 Gai ..... B63B 39/061 114/285
2015/0136011 A1 * 5/2015 Wilson ..... B63B 35/34 114/285

FOREIGN PATENT DOCUMENTS

JP 2009262588 A 11/2009

* cited by examiner

*Primary Examiner* — Anthony D Wiest
(74) *Attorney, Agent, or Firm* — Rabin & Berdo, P.C.

(57) ABSTRACT

A trim tab for a ship comprises a first portion and a second portion. The first portion is swingably mounted to a rear portion of a ship body. The second portion extends from the first portion and curves in a swing direction away from the ship body.

15 Claims, 10 Drawing Sheets

TRIM TAB FOR A SHIP AND A SHIP WITH THE TRIM TAB

CROSS-REFERENCE TO RELATED APPLICATION

This application claims the benefit of the earlier from of Japanese Patent Application No. 2019-074328 filed on Apr. 9, 2019, the contents of which is entirely incorporated herein by reference.

BACKGROUND OF THE INVENTION

1. Field of the Invention

The present invention relates to a trim tab for a ship and a ship with the trim tab.

2. Description of the Related Art

The prior art discloses a configuration in which a trim tab is mounted to a rear portion of a ship body. For example, in Japanese Patent Application Laid-Open No. 2009-262588, a trim tab, which is formed in a plate shape, is mounted to the rear portion of the ship body.

Generally, in case that the flat trim tab of the prior art is used, the flow direction of water changes between the rear end portion of the ship body and the base end portion of the trim tab. A main lift force is generated in a region where the flow direction of the water changes. However, it may be difficult to obtain a sufficient lift force only by the lift force in the region between the rear end of the ship body and the base end of the trim tab, for example, in the region where the flow direction of water changes.

SUMMARY OF THE INVENTION

In view of the above description, preferred embodiments of the present invention provide a trim tab for a ship and a ship with the trim tab, each of which is capable of improving a lifting force acting on a ship body.

A trim tab for a ship according to a preferred embodiment of the present invention includes a first portion and a second portion. The first portion is swingably mounted to a rear portion of a ship body. The second portion extends from the first portion and curves in a swing direction away from the ship body.

A ship according to a preferred embodiment of the present invention includes a ship body and a trim tab mounted to a rear portion of a ship body. The trim tab has a first portion swingably mounted to the rear portion of the ship body and a second portion extending from the first portion and curving in a swing direction away from the ship body.

According to preferred embodiments of the present invention, it is possible to improve a lifting force acting on a ship body on a trim tab for a ship and a ship with the trim tab.

DETAILED DESCRIPTION OF THE PREFERRED EMBODIMENTS

Figure 1:
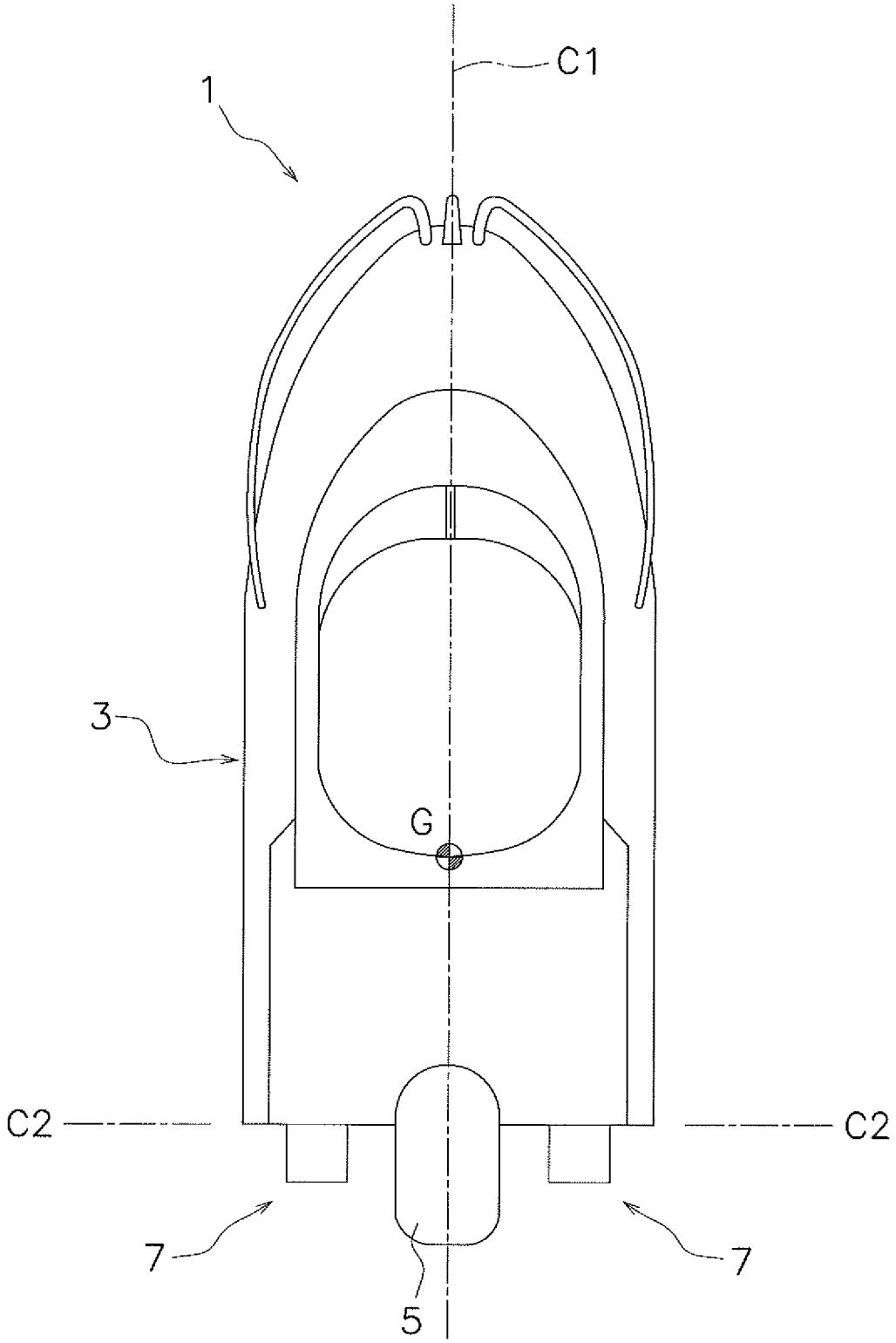
FIG. 1 is a top view of a ship according to a preferred embodiment of the present invention.

Hereinafter, preferred embodiments will be described with reference to the drawings. As shown in FIG. 1, the ship 1 includes a ship body 3 and at least one trim tab 7. Specifically, the ship 1 includes a ship body 3, a propulsion device 5, and a plurality of trim tabs 7 (for example, a pair of trim tabs 7). Here, an example in which one propulsion device 5 is provided is illustrated, but a plurality of propulsion devices 5 can be provided. Further, the number of trim tabs 7 can be one or three or more.

In the following description, the front, rear, left, right, up, and down directions mean the front, rear, left, right, up, and down directions of the ship body 3, respectively. For example, as shown in FIG. 1, a center line C1 extending in the front-rear direction of the ship body 3 passes through the center of gravity G of the ship body 3. The front-back direction extends along the center line C1. The forward direction extends upward along the center line C1 in FIG. 1. The rear direction extends downward along the center line C1 in FIG. 1.

The left-right direction (the width direction) is perpendicular to the center line C1 in FIG. 1. The left direction is perpendicular to the center line C1 and on a left side of the center line C1 in FIG. 1. The right direction is perpendicular to the center line C1 and on a right side of the center line C1 in FIG. 1. The vertical direction is perpendicular to the front-rear direction and the left-right direction.

(Configuration of Propulsion Device)

Figure 2:
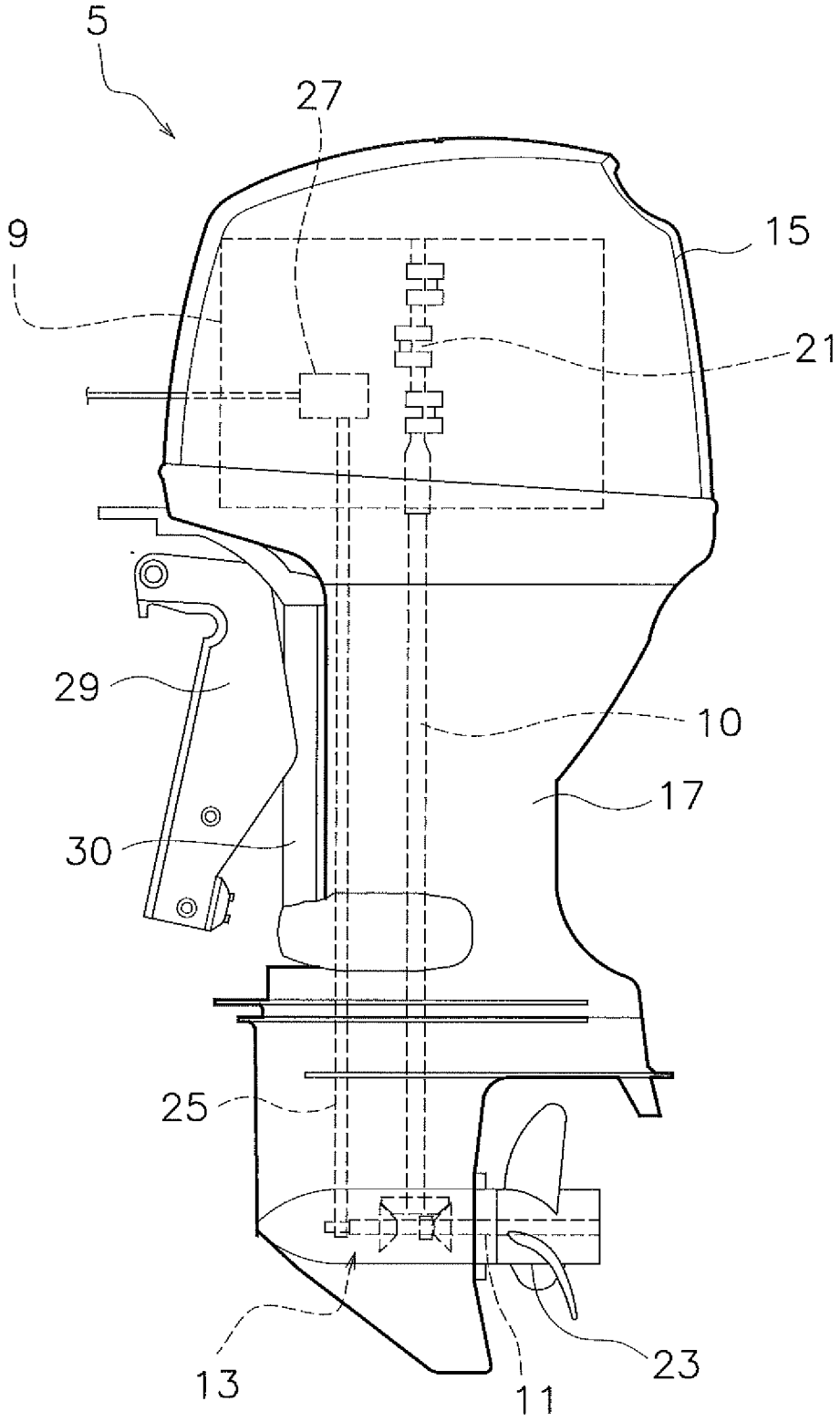
FIG. 2 is a side view of a propulsion device.

As shown in FIG. 2, the propulsion device 5 is an outboard motor. The propulsion device 5 generates a thrust to propel the ship body 3. The propulsion device 5 is attached to the stern of the ship body 3. For example, the propulsion device 5 is disposed between the pair of trim tabs 7.

The propulsion device 5 includes an engine 9, a drive shaft 10, a propeller shaft 11, a shift mechanism 13, an engine cover 15, a housing 17, and a bracket 29.

The engine 9 is a power source for generating the thrust of the ship body 3. The engine 9 is disposed inside the engine cover 15. The engine 9 includes a crankshaft 21. The crankshaft 21 extends in the vertical direction.

The drive shaft 10 is connected to a crankshaft 21. The drive shaft 10 extends downward from engine 9. The propeller shaft 11 extends in a direction intersecting the drive shaft 10. The propeller shaft 11 extends in the front-rear direction. The propeller shaft 11 is connected to the drive shaft 10 via the shift mechanism 13. A propeller 23 is connected to the propeller shaft 11.

The housing 17 is disposed below the engine cover 15. The drive shaft 10, the propeller shaft 11, and the shift mechanism 13 are disposed in the housing 17. The shift mechanism 13 is driven by a shift actuator 27 via a shift member 25. The shift mechanism 13 switches the rotation direction of the power transmitted from the drive shaft 10 to the propeller shaft 11. Thereby, the rotation direction of the propeller 23 is switched to the forward travel direction or the reverse travel direction.

The bracket 29 is used to attach the propulsion device 5 to the ship body 3. The propulsion device 5 is detachably fixed to the stern of the ship body 3 via the bracket 29. The bracket 29 includes a steering shaft 30. The propulsion device 5 is supported by the bracket 29 so as to be rotatable around the steering shaft 30.

(Configuration of Trim tab)

As shown in FIG. 1, the pair of trim tabs 7 are attached to the stern of the ship body 3. For example, each of the pair of trim tabs 7 is swingably attached to the stern of the ship body 3. Specifically, the pair of trim tabs 7 are swingably attached to the stern of the ship body 3 on the left and right sides of the propulsion device 5. Each of the pair of trim tabs 7 is attached to the stern of the ship body 3 so as to be swingable around a swing axis C2.

Figure 3:
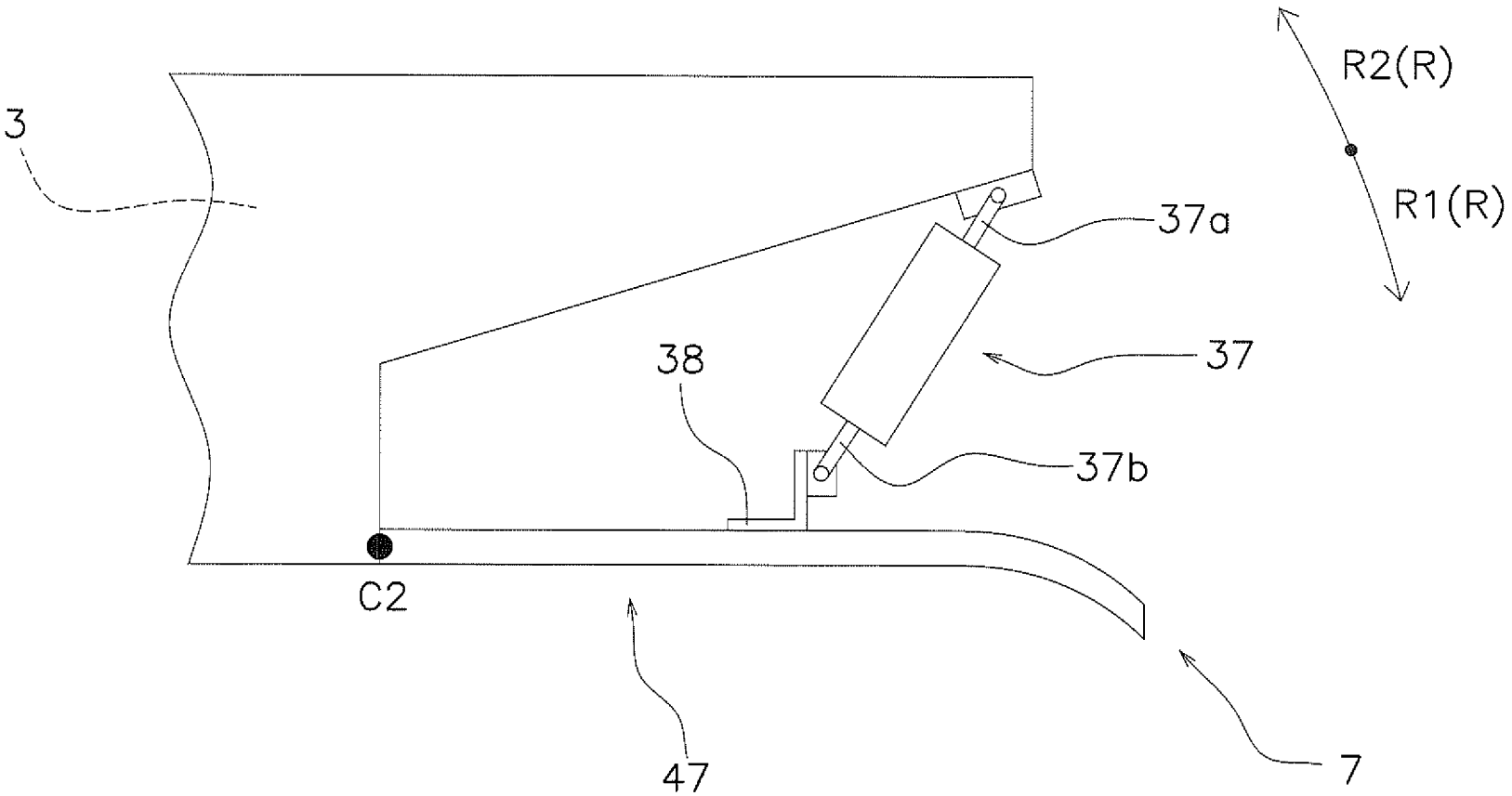
FIG. 3 is a side view of a trim tab mounted to a ship body.
Figure 4:
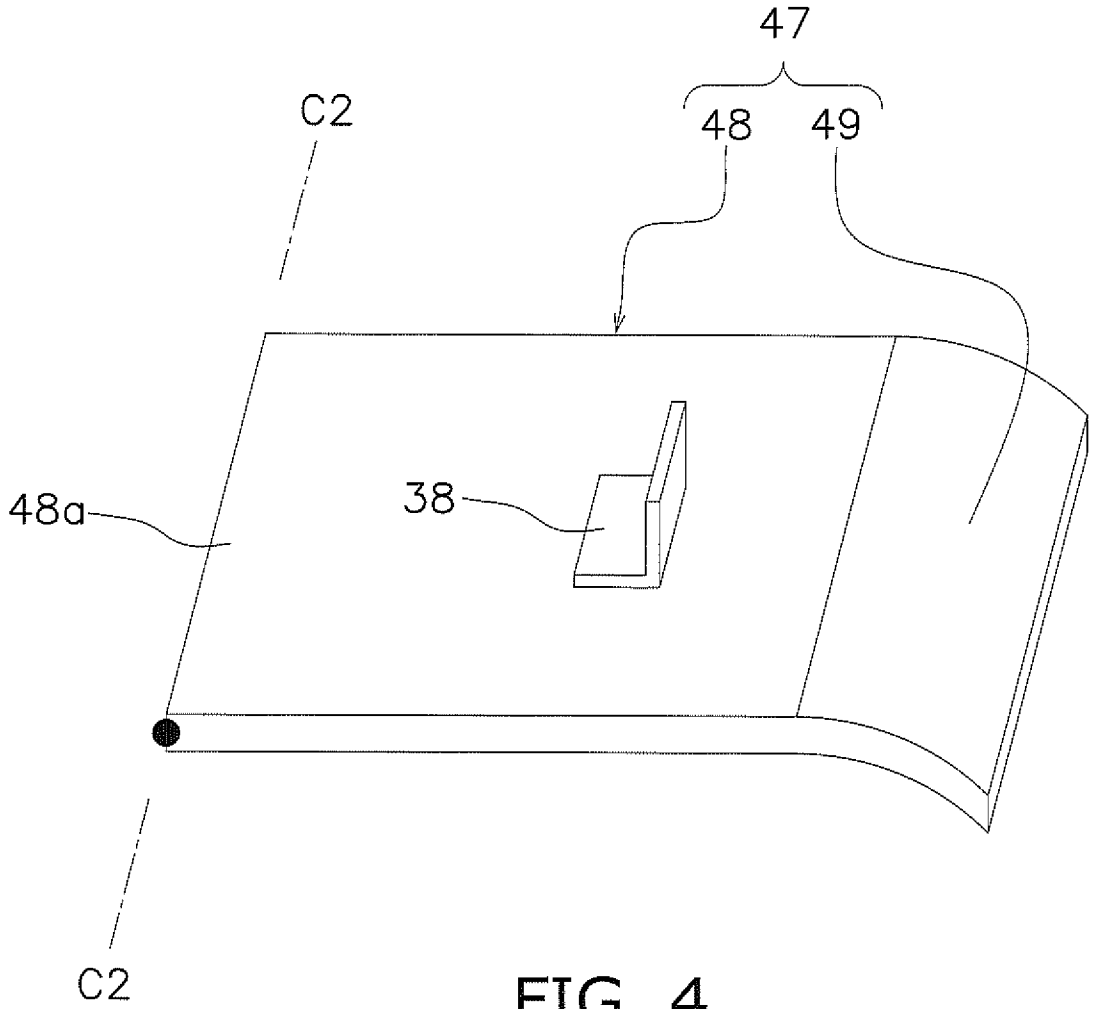
FIG. 4 is a perspective view of the trim tab.

As shown in FIG. 3, each of the trim tabs 7 includes a trim actuator 37 and a tab body 47 (see FIG. 4). Each of the trim actuators 37 is used for swinging each of the tab bodies 47 with respect to the ship body 3. Each of the trim actuators 37 can be a hydraulic actuator or an electric actuator.

Each of the trim actuators 37 is attached to each of the tab bodies 47 and the ship body 3 between each of the tab bodies 47 and the ship body 3. For example, a first end portion 37*a* of the trim actuator 37 is attached to the ship body 3. A second end portion 37*b* of the trim actuator 37 is attached to the tab body 47. The second end portion 37*b* of the trim actuator 37 is attached to the tab body 47 (a flat plate portion 48 described below) via an attachment member 38.

As shown in FIG. 4, the tab body 47 includes a flat plate portion 48 (an example of a first portion) and a curved portion 49 (an example of a second portion). The flat plate portion 48 is swingably attached to the stern of the ship body 3. For example, the base end portion 48*a* of the flat plate portion 48 is attached to the stern of the ship body 3 so as to be swingable around the swing axis C2. The flat plate portion 48 is formed in a flat plate shape. The attachment member 38 is attached to the flat plate portion 48.

As shown in FIG. 3, the swing direction R is defined based on the swing axis C2. In this embodiment, the swing axis C2 extends in a direction orthogonal to the center line C1. For example, the swing axis C2 extends in the left-right direction. The swing axis C2 can extend obliquely so as to intersect the steering shaft 30.

Hereinafter, when each of the tab bodies 47 swings in a direction away from the ship body 3, for example, when each of the tab bodies 47 swings from the ship body 3 toward the water surface, the swing direction R of each of the tab bodies 47 is described as a first swing direction R1.

When each of the tab bodies 47 swings in a direction approaching the ship body 3, for example, when each of the tab bodies 47 swings from the water surface (underwater) toward the ship body 3, the swing direction R of each of the tab bodies 47 is described as a second swing direction R2. The "swing direction R" is used as a phrase to cover swing directions including the first swing direction R1 and the second swing direction R2.

Figure 5:
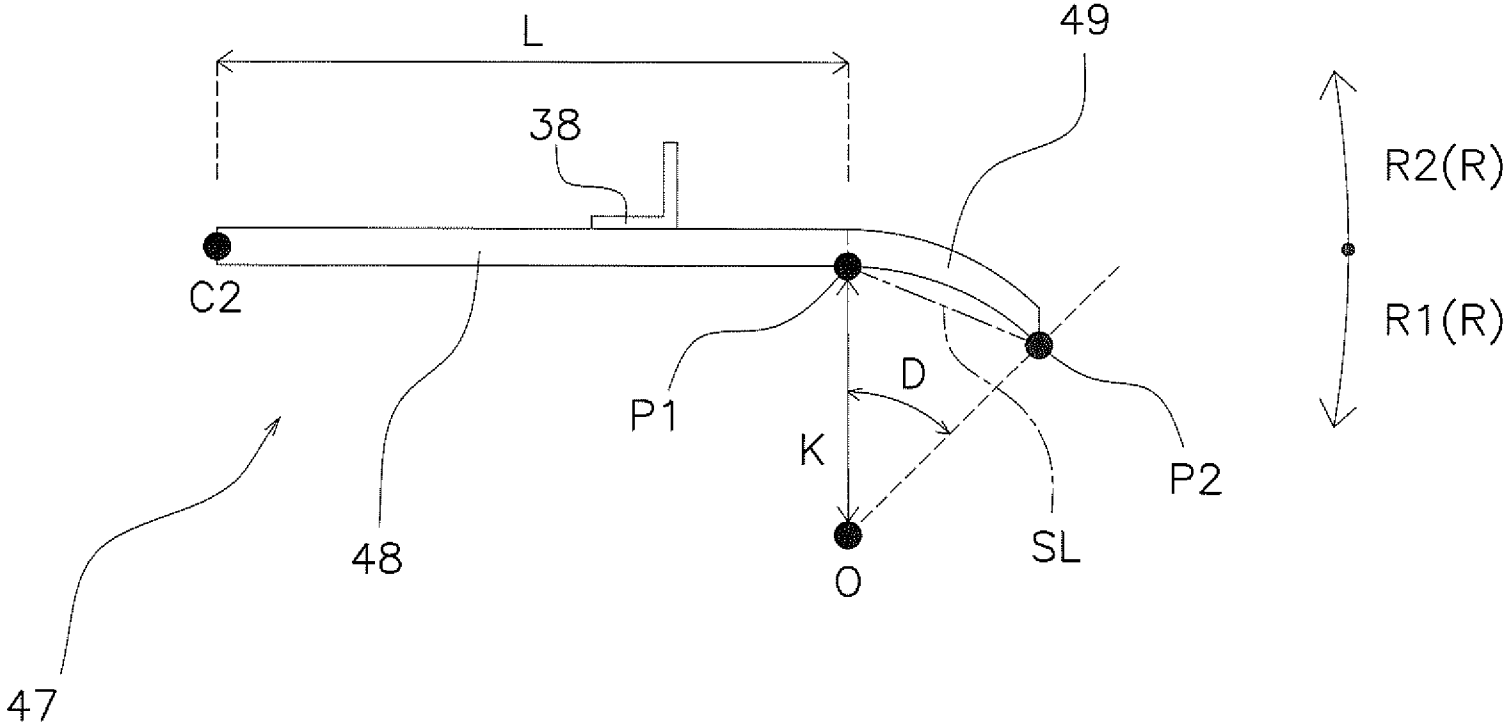
FIG. 5 is a side view of the trim tab.

As shown in FIG. 5, the curved portion 49 extends from the flat plate portion 48 and curves in the first swing direction R1. For example, the curved portion 49 curves from the distal end of the flat plate portion 48 in the first swing direction R1 toward a direction away from the swing axis C2 along the flat plate portion 48.

The curved portion 49 is formed integrally with the flat plate portion 48. For example, the curved portion 49 is formed integrally with the flat plate portion 48 by partially bending a plate member.

In this embodiment, as shown in FIGS. 4 and 5, the curved portion 49 is formed in a two-dimensionally concave shape. As shown in FIG. 5, a straight line SL connecting a base point P1 of the curved portion 49 and a distal point P2 of the curved portion 49 is defined in a side view of the tab body 47. In this state, at least part of the curved portion 49 is disposed between the straight line SL and the ship body 3 in the swing direction R. In this embodiment, the curved portion 49 is disposed between the straight line SL and the ship body 3 in the swing direction R.

The base point P1 of the curved portion 49 is a point at which the curved portion 49 starts bending. The base point P1 of the curved portion 49 may be included in the distal end of the flat plate portion 48. The distal point P2 of the curved portion 49 is defined on the distal end of the tab body 47.

The base point P1 and the distal point P2 of the curved portion 49 are defined on an outer surface of the curved portion 49. Specifically, the base point P1 and the distal point P2 of the curved portion 49 are defined on the outer surface on the opposite side of the ship body 3 in the swing direction R (R1), for example, the outer surface on the water surface side.

The straight line SL can be defined on a cross section of the tab body 47 when the tab body 47 is cut by a plane orthogonal to the swing axis C2. In this case, FIG. 5 can be interpreted as the cross section in which this plane passes through a center point in the width direction of the trim tab 7 (the tab body 47). Here, the width direction of the trim tab 7 (tab body 47) is a direction along the swing axis C2.

The curved portion 49 is preferably formed in an arc shape around a curvature center O in the side view of the tab body 47. The curvature center O is preferably defined on a straight line passing through the base point P1 of the curved portion 49 (the distal end of the flat plate portion 48). For example, the curvature center O is preferably defined on the straight line that passes through the base point P1 of the curved portion 49 (the distal end of the flat plate portion 48) and is orthogonal to the flat plate portion 48. The straight line SL is disposed between the curved portion 49 and the curvature center O.

The shape of the curved portion 49 is formed based on a length L of the flat plate portion 48, a predetermined curvature radius K, and a predetermined curvature angle D. Preferably, the length L of the flat plate portion 48 is 0 mm or more and 300 mm or less, the curvature radius K is 10 mm or more and 1000 mm or less, and the curvature angle D is 10 degrees or more and 45 degrees or less.

For example, when the length L of the flat plate portion 48 is 210 mm, the predetermined curvature radius K is 115 mm and the predetermined curvature angle D is 45 degrees preferably. The length L of the flat plate portion 48 is defined in a direction away from the swing axis C2 (a radial direction with respect to the swing axis C2).

By configuring each of the trim tabs 7 as described above, a lift force can be generated on the ship body 3 in a region between the rear end portion of the ship body 3 and the base end portion 48*a* of the flat plate portion 48. Further, the water flowing from the base end (the swing axis C2) of the tab body 47 toward the rear end (the distal point P2) can be confined in the curved portion 49, so that the lifting force on the ship body 3 is further increased. Thus, the lift force can be improved by using the above trim tabs 7.

Further, by providing the trim tab 7 with the curved portion 49, water can smoothly pass from the front portion (the flat plate portion 48) of the trim tab 7 to the rear portion (the curved portion 49) of the trim tab 7. Thereby, generation of turbulence can be reduced at the boundary between the flat plate portion 48 and the curved portion 49 of the trim tab 7. In other words, the resistance, which acts on the ship body 3 in the travel direction, can be reduced.

Variation of the Embodiment

The configuration of the above embodiment can be configured as follows.

(A1) In the above-described embodiment, an example in which the curved portion 49 (an example of a second portion) is formed by partially bending the plate member is described. In addition to this configuration, a rib portion 50 (an example of a reinforcing portion) can be provided as shown in FIGS. 6A and 6B.

The rib portion 50 is provided to reinforce the tab body 47. The rib portion 50 is provided on the outer surface of the tab body 47. For example, the rib portion 50 is provided on at least one of a pair of outer surfaces of the tab body 47. The rib portion 50 can be separately attached to the outer surface of the tab body 47 or can be integrally formed on the outer surface of the tab body 47. The number of the rib portions 50 can be one or plural.

Figure 6A:
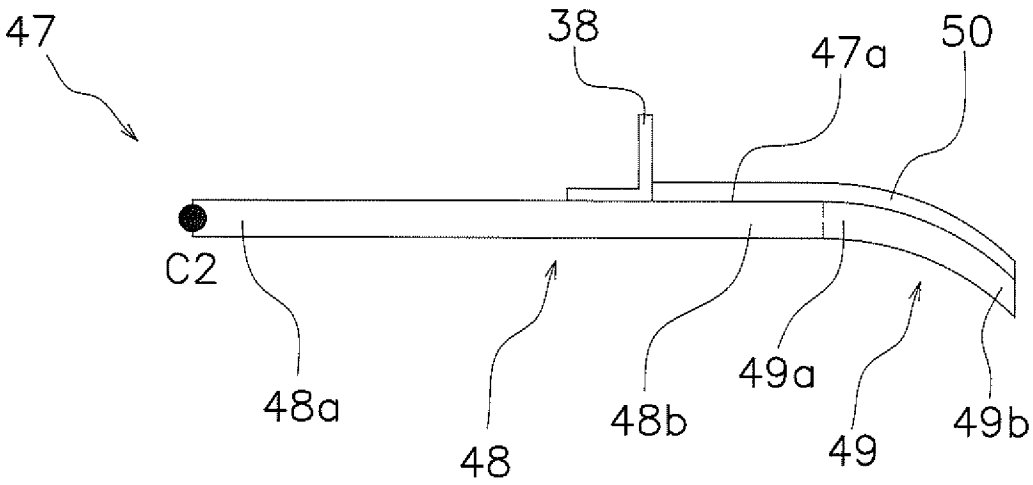
FIG. 6A is a side view of the trim tab according to a variation (A1)
Figure 6B:
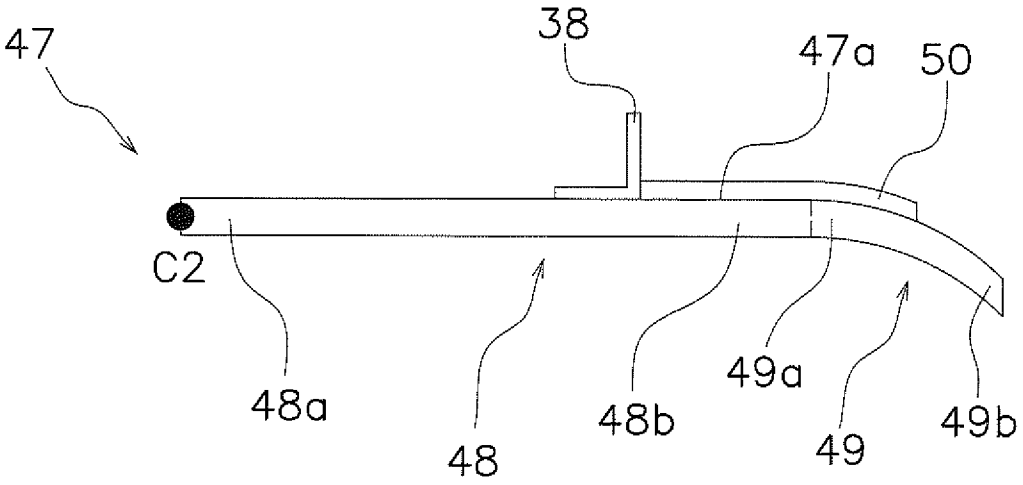
FIG. 6B is a side view of the trim tab according to a variation (A1)

In this variation, an example in which one rib portion 50 is provided on one outer surface 47*a* of the tab body 47 as shown in FIGS. 6A and 6B is described. The outer surface 47*a* is defined on the outer surface on the ship body side in the swing direction R, for example, the outer surface of the ship side in the first swing direction R1

The rib portion 50 is provided on at least one of the flat plate portion 48 and the curved portion 49. Here, the rib portion 50 is provided on the flat plate portion 48 and the curved portion 49. For example, the rib portion 50 extends along the outer surface 47*a* of the tab body 47 from the distal end portion 48*b* of the flat plate portion 48 toward the distal end portion 49*b* of the curved portion 49. Specifically, the rib portion 50 extends along the outer surface 47*a* of the tab body 47 from the distal end portion 49*b* of the curved portion 49 to the attachment member 38.

Thereby, when the lift force acts on the curved portion 49, the deformation of the tab body 47 can be prevented by the rib portion 50. A base end portion 49*a* of the curved portion 49 includes the base point P1. The distal end portion 49*b* of the curved portion 49 includes the distal point P2.

As shown in FIG. 6B, the rib portion 50 can be provided only on the distal end portion 48*b* of the flat plate portion 48 and the base end portion 49*a* of the curved portion 49. Even if this configuration is used, when the lift force acts on the curved portion 49, the deformation of the tab body 47 can be prevented by the rib portion 50.

(A2) In the above-described embodiment, an example in which the curved portion 49 is formed in the two-dimensionally concave shape is described. Instead of this, the curved portion 49 can be formed in a three-dimensionally concave shape.

Figure 7A:
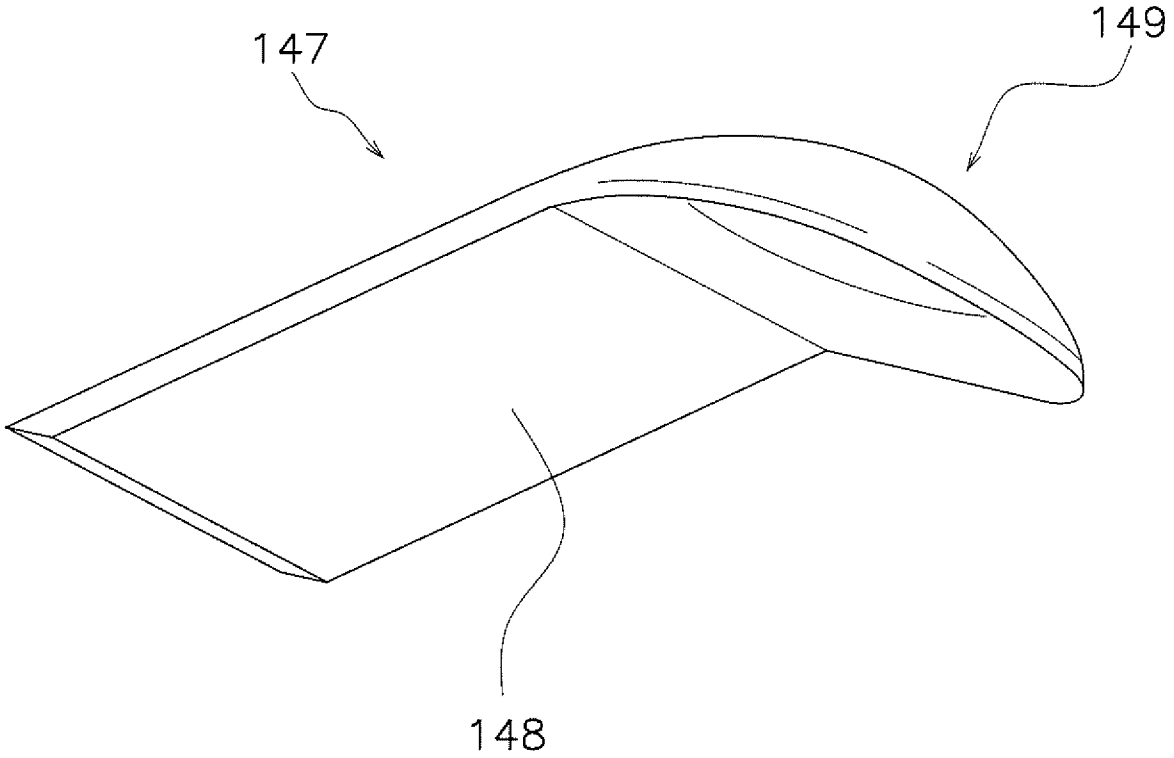
FIG. 7A is a perspective view of the trim tab according to a variation (A2).

In this case, as shown in FIG. 7A, the curved portion 149 of the tab body 147 is formed by partially curving a plate member into a bowl shape. The flat plate portion 148 of the tab body 147 has the same configuration as that of the above embodiment.

Figure 7C:
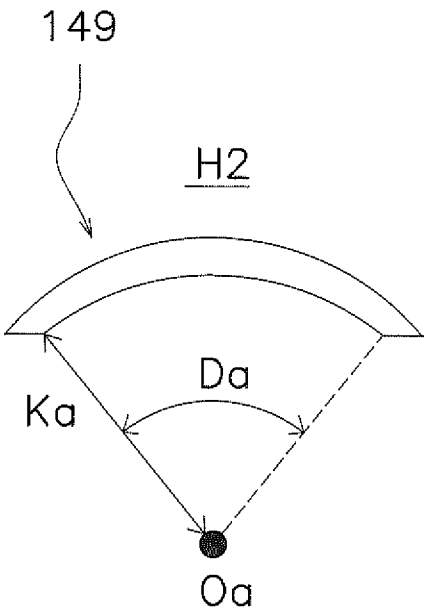
FIG. 7C is a sectional view of the trim tab according to a variation (A2).
Figure 7B:
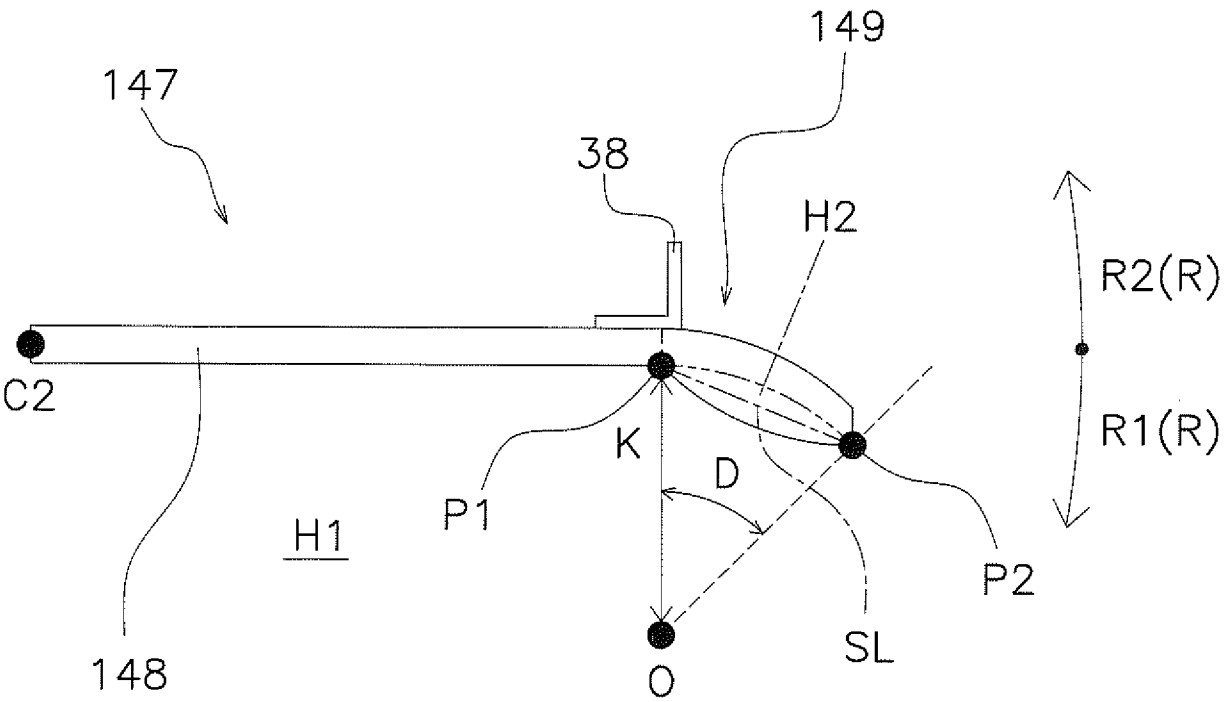
FIG. 7B is a side view of the trim tab according to a variation (A2).

As shown in FIG. 7B, the curved portion 149 is arranged so as to include the straight line SL in a side view of the tab body 147. In the cross section of the tab body 147 in a state where the tab body 147 is cut by a plane H1 orthogonal to the swing axis C2, the curved portion 49 is preferably formed in an arc shape around the curvature center O such as in the above-described embodiment.

The attachment member 38 is preferably provided at the distal end of the flat plate portion 148 and the base end portion of the curved portion 149 in the radial direction from the curvature center O toward the base point P1. Thereby, when the lift force acts on the curved portion 149, the deformation of the tab body 147 can be prevented by the attachment member 38.

When the attachment member 38 is provided on the tab body 147 in the same manner as in the above-described embodiment (see FIG. 5), the rib portion 50 of the variation (A1) is preferably provided on the tab body 147 (FIG. And FIG. 6B).

Also, as shown in FIG. 7C, in the cross section of the tab body 47 in a state where the curved portion 49 is cut by the plane H2 including the curvature center O, the curved portion 49 is preferably formed in an arc shape around the curvature center O. Is preferably formed. In this case, the position of the curvature center Oa, the curvature radius Ka, and the curvature angle Da can be set in the same manner as in the above embodiment, or can be set differently from the above embodiment.

By forming the curved portion 49 in this manner, the water flowing from the base end (the swing axis C2) of the tab body 147 toward the distal end (the distal point P2) of the tab body 147 can be confined in the curved portion 49. Thereby, the lift force can be improved.

Further, water can be confined in the curved portion 149 in the direction (the left-right direction) along the swing axis C2. Thereby, the lift force can be further improved.

In addition, by forming the curved portion 149 in the three-dimensional shape, the deformation of the curved portion 149 can be suitably prevented when a lifting force acts on the curved portion 49.

Figure 8:
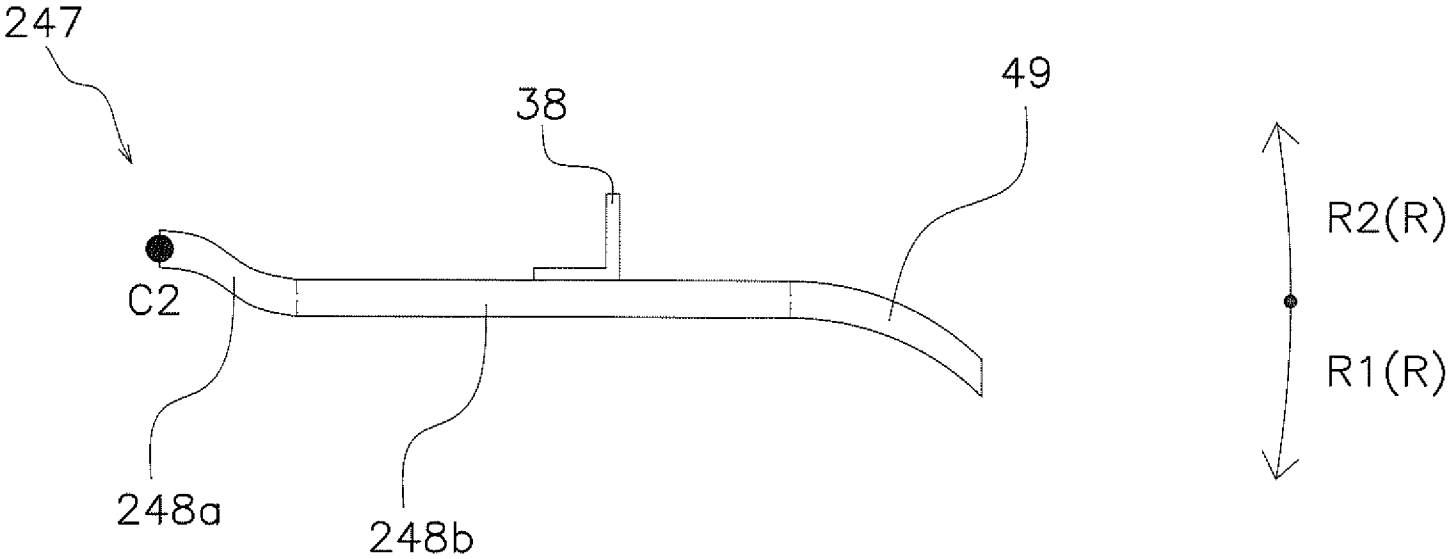
FIG. 8 is a side view of the trim tab according to a variation (A3).

(A3) In the above-described embodiment, an example in which the flat plate portion 48 is entirely formed in a flat plate shape is described. The flat plate portion 48 can be partially curved. For example, as shown in FIG. 8, only the base end portion 248*a* (an example of a front end) of the flat plate portion 248 can be curved.

In this case, the flat plate portion 248 of the tab body 247 has a main body 248*b* and a base end portion 248*a*. The main body 248*b* is formed in a flat plate shape. The base end portion 248*a* is formed to be curved. For example, in a side view of the tab body 247, the base end portion 248*a* is formed to be curved. In the side view of the tab body 247, the base end portion 248*a* is preferably formed in a two-dimensionally concave shape, for example, in a S-shape.

By configuring the base end portion 248*a* of the flat plate portion 248 in this manner, water can smoothly pass from the ship body 3 to the base end portion 248*a* of the flat plate portion 248. Further, water can smoothly pass from the base end portion 248*a* of the flat plate portion 248 to the main body 248*b*. As a result, the generation of turbulence at the boundary between the ship body 3 and the trim tab 7 can be reduced. In other words, the resistance, which acts on the ship body 3 in the travel direction, can be reduced.

The Other Embodiments

The configuration of the above embodiment can be configured as follows.

(B1) The shape of the curved portion 49 of the above embodiment is not limited to the above embodiment, and the shape of the curved portion 49 can have any shape as long as it is a two-dimensional concave shape or a three-dimensional concave shape.

(B2) The shape of the curved portion 49 of the above embodiment, for example, the position of the curvature center O, the curvature radius K, and the curvature angle D can have any setting as long as the curved portion 49 extends from the flat plate portion 48 and curves in the first swing direction R1.

INDUSTRIAL APPLICABILITY

According to the preferred embodiments of the present invention, it is possible to improve a lifting force acting on a ship body on a trim tab for a ship and a ship with the trim tab.

What is claimed is:

1. A trim tab for a ship, the trim tab comprising:

a first portion configured to be swingably mounted to a rear portion of a ship body, the first portion including a flat plate portion having a flat plate shape; and a second portion extending from the first portion, configured to curve in a swing direction away from the ship body, and having a predetermined curvature radius;

wherein a length of the first portion is greater than a length of a straight line connecting a base point at an end of the first portion where the second portion begins to curve and a distal end of the second portion.

2. The trim tab for a ship according to claim 1, wherein at least part of the second portion is configured to be disposed between the straight line and the ship body in the swing direction.

3. The trim tab for a ship according to claim 1, wherein the second portion is a partially bent portion of a plate member.

4. The trim tab for a ship according to claim 1, comprising a reinforcing rib portion extending along an outer surface of at least one of the first portion and the second portion.

5. The trim tab for a ship according to claim 4, wherein the reinforcing rib portion conforms to a shape of the outer surface.

6. The trim tab for a ship according to claim 1, wherein a front end of the first portion is curved.

7. The trim tab for a ship according to claim 1, wherein the second portion has a two-dimensionally concave shape.

8. A ship comprising:

a ship body; and a trim tab comprising a first portion configured to be swingably mounted to a rear portion of the ship body, the first portion including a flat plate portion having a flat plate shape, and a second portion extending from the first portion, configured to curve in a swing direction away from the ship body, and having a predetermined curvature radius;

wherein a length of the first portion is greater than a length of a straight line connecting a base point at an end of the first portion where the second portion begins to curve and a distal end of the second portion.

9. The ship according to claim 8, wherein:

at least part of the second portion is configured to be disposed between the straight line and the ship body in the swing direction.

10. The ship according to claim 8, wherein the second portion is a partially bent portion of a plate member.

11. The ship according to claim 8, wherein the trim tab comprises a reinforcing portion on at least one of the first portion and the second portion.

12. The ship according to claim 8, wherein a front end of the first portion is curved.

13. The ship according to claim 8, wherein:

the ship comprises an actuator having a first end portion attached to the ship body and a second end portion attached to an attachment member on an upper surface of the flat plate portion; and the actuator is angled inwardly from the first end portion toward a swing axis of the flat plate portion.

14. A trim tab for a ship, the trim tab comprising:

a first portion configured to be swingably mounted to a rear portion of a ship body; and a second portion extending from the first portion, configured to curve in a swing direction away from the ship body, and having a predetermined curvature radius;

wherein the second portion is a partially bent portion of a plate member; and wherein the second portion has a three-dimensionally concave shape.

15. A ship comprising:

a ship body; and a trim tab comprising a first portion configured to be swingably mounted to a rear portion of the ship body, and a second portion extending from the first portion, configured to curve in a swing direction away from the ship body, and having a predetermined curvature radius;

wherein the second portion is a partially bent portion of a plate member; and wherein the second portion has a bowl shape.

* * * * *